US008715480B2

(12) United States Patent
Anex et al.

(10) Patent No.: US 8,715,480 B2
(45) Date of Patent: May 6, 2014

(54) ELECTROKINETIC PUMP HAVING CAPACITIVE ELECTRODES

(75) Inventors: Deon S. Anex, Livermore, CA (US); Phillip H. Paul, Livermore, CA (US); David W. Neyer, Castro Valley, CA (US)

(73) Assignee: Eksigent Technologies, LLC, Dublin, CA (US)

( * ) Notice: Subject to any disclaimer, the term of this patent is extended or adjusted under 35 U.S.C. 154(b) by 0 days.

(21) Appl. No.: 13/462,634

(22) Filed: May 2, 2012

(65) Prior Publication Data

US 2012/0219430 A1 Aug. 30, 2012

Related U.S. Application Data

(60) Continuation of application No. 13/013,484, filed on Jan. 25, 2011, now Pat. No. 8,192,604, which is a continuation of application No. 11/684,500, filed on Mar. 9, 2007, now Pat. No. 7,875,159, which is a division of application No. 10/273,723, filed on Oct. 18, 2002, now Pat. No. 7,235,164.

(51) Int. Cl.
*F04F 99/00* (2009.01)

(52) U.S. Cl.
USPC ..... 204/600; 204/450; 417/48

(58) Field of Classification Search
USPC ..... 204/450, 600
See application file for complete search history.

(56) References Cited

U.S. PATENT DOCUMENTS

| | | | |
|---|---|---|---|
| 1,063,204 | A | 6/1913 | Kraft |
| 2,615,940 | A | 10/1952 | Williams |
| 2,644,900 | A | 7/1953 | Hardway, Jr. |
| 2,644,902 | A | 7/1953 | Hardway, Jr. |
| 2,661,430 | A | 12/1953 | Hardway, Jr. |
| 2,841,324 | A | 7/1958 | Santeler |
| 2,995,714 | A | 8/1961 | Hannah |
| 3,143,691 | A | 8/1964 | Hurd |
| 3,209,255 | A | 9/1965 | Estes et al. |
| 3,298,789 | A | 1/1967 | Mast |
| 3,427,978 | A | 2/1969 | Hanneman at al. |
| 3,544,237 | A | 12/1970 | Walz |
| 3,587,227 | A | 6/1971 | Weingarten et al. |

(Continued)

FOREIGN PATENT DOCUMENTS

| | | |
|---|---|---|
| CN | 2286429 Y | 7/1998 |
| DE | 1817719 A1 | 7/1970 |

(Continued)

OTHER PUBLICATIONS

Adamson et al., Physical Chemistry of Surfaces, pp. 185-187; John Wiley & Sons, Inc., NY; (Aug. 4, 1997).

(Continued)

*Primary Examiner* — Keith Hendricks
*Assistant Examiner* — Kourtney S Carlson
(74) *Attorney, Agent, or Firm* — Shay Glenn LLP

(57) ABSTRACT

An electrokinetic pump achieves high and low flow rates without producing significant gaseous byproducts and without significant evolution of the pump fluid. A first feature of the pump is that the electrodes in the pump are capacitive with a capacitance of at least $10^{-4}$ Farads/cm$^2$. A second feature of the pump is that it is configured to maximize the potential across the porous dielectric material. The pump can have either or both features.

19 Claims, 8 Drawing Sheets

(56) References Cited

U.S. PATENT DOCUMENTS 3,604,417 A 9/1971 Stolzenberg
3,630,957 A 12/1971 Rey et al.
3,666,379 A 5/1972 Mitchel et al.
3,682,239 A 8/1972 Abu-Romia
3,714,528 A 1/1973 Vail
3,739,573 A 6/1973 Giner
3,923,426 A 12/1975 Theeuwes
3,952,577 A 4/1976 Hayes et al.
4,043,895 A 8/1977 Gritzner
4,140,122 A 2/1979 Kuhl et al.
4,209,014 A 6/1980 Sefton
4,240,889 A 12/1980 Yoda et al.
4,316,233 A 2/1982 Chato et al.
4,383,265 A 5/1983 Kohashi
4,396,925 A 8/1983 Kohashi
4,402,817 A 9/1983 Maget
4,552,277 A 11/1985 Richardson et al.
4,634,431 A 1/1987 Whitney et al.
4,639,244 A 1/1987 Rizk et al.
4,687,424 A 8/1987 Heimes
4,704,324 A 11/1987 Davis et al.
4,789,801 A 12/1988 Lee
4,808,152 A 2/1989 Sibalis
4,886,514 A 12/1989 Maget
4,902,278 A 2/1990 Maget et al.
4,908,112 A 3/1990 Pace
4,921,041 A 5/1990 Akachi
4,999,069 A 3/1991 Brackett et al.
5,004,543 A 4/1991 Pluskal et al.
5,037,457 A 8/1991 Goldsmith et al.
5,087,338 A 2/1992 Perry et al.
5,116,471 A 5/1992 Chien et al.
5,126,022 A 6/1992 Soane et al.
5,137,633 A 8/1992 Wang
5,219,020 A 6/1993 Akachi
5,260,855 A 11/1993 Kaschmitter et al.
5,279,608 A 1/1994 Cherif Cheikh
5,288,214 A 2/1994 Fukuda et al.
5,296,115 A 3/1994 Rocklin et al.
5,312,389 A 5/1994 Theeuwes et al.
5,351,164 A 9/1994 Grigortchak et al.
5,418,079 A 5/1995 Diethelm
5,523,177 A * 6/1996 Kosek et al. ..... 429/480
5,531,575 A 7/1996 Lin
5,534,328 A 7/1996 Ashmead et al.
5,573,651 A 11/1996 Dasgupta et al.
5,581,438 A 12/1996 Halliop
5,628,890 A 5/1997 Carter et al.
5,632,876 A 5/1997 Zanzucchi et al.
5,658,355 A 8/1997 Cottevieille et al.
5,683,443 A 11/1997 Munshi et al.
5,766,435 A 6/1998 Liao et al.
5,858,193 A 1/1999 Zanzucchi et al.
5,862,035 A 1/1999 Farahmandi et al.
5,888,390 A 3/1999 Craig
5,891,097 A 4/1999 Saito et al.
5,942,093 A 8/1999 Rakestraw et al.
5,942,443 A 8/1999 Parce et al.
5,958,203 A 9/1999 Parce et al.
RE36,350 E 10/1999 Swedberg et al.
5,961,800 A 10/1999 McBride et al.
5,964,997 A 10/1999 McBride
5,989,402 A 11/1999 Chow et al.
5,997,708 A 12/1999 Craig
6,007,690 A 12/1999 Nelson et al.
6,012,902 A 1/2000 Parce
6,013,164 A 1/2000 Paul et al.
6,019,745 A 2/2000 Gray
6,019,882 A 2/2000 Paul et al.
6,045,933 A 4/2000 Okamoto
6,054,034 A 4/2000 Soane et al.
6,068,752 A 5/2000 Dubrow et al.
6,068,767 A 5/2000 Garguilo et al.
6,074,725 A 6/2000 Kennedy
6,086,243 A 7/2000 Paul et al.
6,090,251 A 7/2000 Sundberg et al.
6,100,107 A 8/2000 Lei et al.
6,106,685 A 8/2000 McBride et al.
6,113,766 A 9/2000 Steiner et al.
6,126,723 A 10/2000 Drost et al.
6,129,973 A 10/2000 Martin et al.
6,137,501 A 10/2000 Wen et al.
6,150,089 A 11/2000 Schwartz
6,156,273 A 12/2000 Regnier et al.
6,159,353 A 12/2000 West et al.
6,176,962 B1 1/2001 Soane et al.
6,179,586 B1 1/2001 Herb et al.
6,210,986 B1 4/2001 Arnold et al.
6,224,728 B1 5/2001 Oborny et al.
6,255,551 B1 7/2001 Shapiro et al.
6,257,844 B1 7/2001 Stern
6,260,579 B1 7/2001 Yokota et al.
6,267,858 B1 7/2001 Parce et al.
6,277,257 B1 8/2001 Paul et al.
6,287,438 B1 9/2001 Knoll
6,287,440 B1 9/2001 Arnold et al.
6,290,909 B1 9/2001 Paul et al.
6,320,160 B1 11/2001 Eidsnes et al.
6,344,120 B1 2/2002 Haswell et al.
6,349,740 B1 2/2002 Cho et al.
6,379,402 B1 4/2002 Suhara et al.
6,406,605 B1 6/2002 Moles
6,409,698 B1 6/2002 Robinson et al.
6,418,966 B2 7/2002 Loo
6,418,968 B1 7/2002 Pezzuto et al.
6,444,150 B1 9/2002 Arnold
6,460,420 B1 10/2002 Paul et al.
6,472,443 B1 10/2002 Shepodd
6,477,410 B1 11/2002 Henley et al.
6,495,015 B1 12/2002 Schoeniger et al.
6,529,377 B1 3/2003 Somadder et al.
6,561,208 B1 5/2003 O'Connor et al.
6,572,823 B1 6/2003 Donahue et al.
6,613,211 B1 9/2003 McCormick et al.
6,619,925 B2 9/2003 Ohkawa
6,655,923 B1 12/2003 Lisec et al.
6,685,442 B2 2/2004 Chinn et al.
6,689,373 B2 2/2004 Johnson et al.
6,719,535 B2 4/2004 Rakestraw et al.
6,729,352 B2 5/2004 O'Connor et al.
6,733,244 B1 5/2004 Fritsch et al.
6,770,182 B1 8/2004 Griffiths et al.
6,770,183 B1 8/2004 Hencken et al.
6,814,859 B2 11/2004 Koehler et al.
6,878,473 B2 4/2005 Yamauchi et al.
6,881,312 B2 4/2005 Kopf-Sill et al.
6,942,018 B2 9/2005 Goodson et al.
6,952,962 B2 10/2005 Hasselbrink et al.
7,094,464 B2 8/2006 Mao et al.
7,101,947 B2 9/2006 Schlenoff et al.
7,235,164 B2 6/2007 Anex et al.
7,267,753 B2 9/2007 Anex et al.
7,364,647 B2 4/2008 Paul et al.
7,399,398 B2 7/2008 Rakestraw et al.
7,429,317 B2 9/2008 Paul
7,470,267 B2 12/2008 Joshi et al.
7,517,440 B2 4/2009 Anex et al.
7,521,140 B2 4/2009 Arnold et al.
7,559,356 B2 7/2009 Paul et al.
7,575,722 B2 8/2009 Arnold
7,867,592 B2 1/2011 Nelson et al.
7,875,159 B2 1/2011 Anex et al.
8,152,477 B2 4/2012 Anex et al.
8,192,604 B2 6/2012 Anex et al.
2001/0008212 A1 7/2001 Shepodd et al.
2001/0052460 A1 12/2001 Chien et al.
2002/0048425 A1 4/2002 McBride et al.
2002/0056639 A1 5/2002 Lackritz et al.
2002/0066639 A1 6/2002 Taylor et al.
2002/0070116 A1 6/2002 Ohkawa
2002/0076598 A1 6/2002 Bostaph et al.
2002/0089807 A1 7/2002 Bluvstein et al.
2002/0125134 A1 9/2002 Santiago et al.
2002/0166592 A1 11/2002 Liu et al.

(56) References Cited

U.S. PATENT DOCUMENTS

| | | | |
|---|---|---|---|
| 2002/0187074 | A1 | 12/2002 | O'Connor et al. |
| 2002/0187197 | A1 | 12/2002 | Caruso et al. |
| 2002/0187557 | A1 | 12/2002 | Hobbs et al. |
| 2002/0189947 | A1 | 12/2002 | Paul et al. |
| 2002/0195344 | A1 | 12/2002 | Neyer et al. |
| 2003/0044669 | A1 | 3/2003 | Hidaka et al. |
| 2003/0052007 | A1 | 3/2003 | Paul et al. |
| 2003/0061687 | A1 | 4/2003 | Hansen et al. |
| 2003/0114837 | A1 | 6/2003 | Peterson et al. |
| 2003/0116738 | A1 | 6/2003 | O'Connor et al. |
| 2003/0138678 | A1 | 7/2003 | Preidel |
| 2003/0190514 | A1 | 10/2003 | Okada et al. |
| 2003/0198130 | A1 | 10/2003 | Karp et al. |
| 2003/0198576 | A1 | 10/2003 | Coyne et al. |
| 2003/0206806 | A1 | 11/2003 | Paul et al. |
| 2003/0215686 | A1 | 11/2003 | DeFilippis et al. |
| 2003/0226754 | A1 | 12/2003 | Le Febre |
| 2003/0232203 | A1 | 12/2003 | Mutlu et al. |
| 2004/0070116 | A1 | 4/2004 | Kaiser et al. |
| 2004/0101421 | A1 | 5/2004 | Kenny et al. |
| 2004/0106192 | A1 | 6/2004 | Jeon et al. |
| 2004/0115731 | A1 | 6/2004 | Hansen et al. |
| 2004/0129568 | A1 | 7/2004 | Seul et al. |
| 2004/0163957 | A1 | 8/2004 | Neyer et al. |
| 2004/0238052 | A1 | 12/2004 | Karp et al. |
| 2004/0241006 | A1 | 12/2004 | Taboryski et al. |
| 2004/0247450 | A1 | 12/2004 | Kutchinsky et al. |
| 2004/0248167 | A1 | 12/2004 | Quake et al. |
| 2005/0166980 | A1 | 8/2005 | Unger et al. |
| 2005/0235733 | A1 | 10/2005 | Holst et al. |
| 2005/0252772 | A1 | 11/2005 | Paul et al. |
| 2007/0148014 | A1 | 6/2007 | Anex et al. |
| 2007/0224055 | A1 | 9/2007 | Anex et al. |
| 2008/0173545 | A1 | 7/2008 | Anex et al. |
| 2009/0148308 | A1 | 6/2009 | Saleki et al. |
| 2011/0031268 | A1 | 2/2011 | Anex et al. |
| 2013/0085462 | A1 | 4/2013 | Nip et al. |

FOREIGN PATENT DOCUMENTS

| | | | |
|---|---|---|---|
| EP | 0178601 | A2 | 4/1986 |
| EP | 0421234 | A2 | 4/1991 |
| EP | 1063204 | A2 | 12/2000 |
| JP | H02-229531 | | 9/1990 |
| JP | 03-087659 | A | 4/1991 |
| JP | U04-034468 | | 3/1992 |
| JP | 07269971 | A | 10/1995 |
| JP | 09270265 | A | 10/1997 |
| JP | 02-265598 | | 9/2002 |
| SU | 619189 | A | 8/1978 |
| WO | WO 94/05354 | A1 | 3/1994 |
| WO | WO 96/39252 | A1 | 12/1996 |
| WO | WO 99/16162 | A1 | 4/1999 |
| WO | WO 00/04832 | A1 | 2/2000 |
| WO | WO 00/55502 | A1 | 9/2000 |
| WO | WO 00/79131 | A1 | 12/2000 |
| WO | WO 01/25138 | A1 | 4/2001 |
| WO | WO 02/068821 | A2 | 9/2002 |
| WO | WO 02/086332 | A1 | 10/2002 |
| WO | WO 2004/007348 | A1 | 1/2004 |

OTHER PUBLICATIONS

Ananthakrishnan et al., Laminar Dispersion in capillaries; A.I. Ch.E. Journal, 11(6):1063-1072 (Nov. 1965).

Aris, R.; On the dispersion of a solute in a fluid flowing through a tube. Proceedings of the Royal Society of London; Series A, Mathematical and Physical Sciences; vol. 235, No. 1200; pp. 67-77; (Apr. 10, 1956).

Baquiran et al.; Lippincott's Cancer Chemotherapy Handbook; 2nd Ed; Lippincott; Philadelphia; (Jan. 1, 2001).

Becker et al; Polymer microfabrication methods for microfluidic analytical applications; Electrophoresis; vol. 21; pp. 12-26; (Jan. 2000).

Belfer et al.; Surface Modification of Commercial Polyamide Reverse Osmosis Membranes; J. Membrane Sci.; 139; pp. 175-181; (Feb. 18, 1998).

Bello et al; Electroosmosis of polymer solutions in fused silica capillaries; Electrophoresis; vol. 15; pp. 623-626; (May 1994).

Boger, D.; Demonstration of upper and lower Newtonian fluid behaviour in a pseudoplastic fluid; Nature; vol. 265; pp. 126-128 (Jan. 13, 1977).

Buchholz et al.; Microchannel DNA sequencing matrices with switchable viscosities; Electrophoresis; vol. 23; pp. 1398-1409; (May 2002).

Burgreen et al.; Electrokinetic flow in ultrafine capillary slits; The Journal of Physical Chemistry, 68(95): pp. 1084-1091 (May 1964).

Caruso et al.; Investigation of electrostatic interactions in polyelectrolyte multilayer fills: binding of anionic fluorescent probes to layers assemble onto colloids; Macromolecules; vol. 32(7); pp. 2317-2328 (month unavailable 1999).

Chaiyasut et al.; Estimation of the dissociation constants for functional groups on modified and unmodified gel supports from the relationship between electroosmotic flow velocity and pH; Electrophoresis; vol. 22(7); pp. 1267-1272; (Apr. 2001).

Chatwin et al.; The effect of aspect ratio on longitudinal diffusivity in rectangular channels; J. Fluid Mech.; vol. 120; pp. 347-358 (Jul. 1982).

Chu et al.; Physicians Cancer Chemotherapy Drug Manual 2002; Jones and Bartlett Publisher; Massachusetts; (Mar. 25, 2002).

Churchill et al.; Complex Variables and Applications; McGraw-Hill, Inc. New York; (month unavailable 1990).

Collins, Kim; Charge density-dependent strength of hydration and biological structure; Biophys. J.; vol. 72; pp. 65-76; (Jan. 1997).

Conway, B.E.; Electrochemical Supercapacitors Scientific Fundamentals and Technological Applications; Kluwer Academic/Plenum Publishers; pp. 12-13, pp. 104-105, and pp. 192-195; (month unavailable 1999).

Cooke Jr., Claude E.; Study of electrokinetic effects using sinusoidal pressure and voltage; The Journal of Chemical Physics; vol. 23; No. 12; pp. 2299-2300; (Dec. 1955).

Dasgupta et al.; Electroosmosis: a reliable fluid propulsion system for flow injection analysis; Anal. Chem.; vol. 66; No. 11; pp. 1792-1798; (Jun. 1, 1994).

Decher, Fuzzy Nanoassemblies: Toward Layers Polymeric Multicomposites; Science; vol. 277; pp. 1232-1237; (Aug. 29, 21997).

DeGennes; Scaling Concepts in Polymer Physics; Cornell U. Press; p. 223; (Nov. 30, 1979).

Doshi et al.; Three dimensional laminar dispersion in open and closed rectangular conduits; Chemical Engineering Science; vol. 33(7); pp. 795-804; (month unavailable 1978).

Drott et al.; Porous silicon as the carrier matrix in microstructured enzyme reactors yielding high enzyme activities; J. Micromech. Microeng; vol. 7(1); pp. 14-23 (month unavailable 1997).

Gan et al.; Mechanism of porous core electroosmotic pump flow injection system and its application to determination of chromium(VI) in waste-water; Talanta; vol. 51(4); pp. 667-675 (Apr 3, 2000).

Gennaro, A.R.; Remington: The Science and Practice of Pharmacy (20th ed.); Lippincott Williams & Wilkins. Philadelphia; (Dec. 2000).

Gleiter et al.; Nanocrystalline Materials: A Way to Solids with Tunable Electronic Structures and Properties?; Acta Mater; vol. 49(4); pp. 737-745; (Feb. 23, 2001).

Gongora-Rubio et al.; The utilization of low temperature co-fired ceramics (LTCC-ML) technology for meso-scale EMS, a simple thermistor based flow sensor; Sensors and Actuators; vol. 73; No. 3; pp. 215-221; (Mar. 30, 1999).

Goodman and Gilman's "The Pharmacological Basis of Therapeutics;" (10th Ed.); Hardman et al. (editors); (Aug. 13, 2001).

Gritsch et al.; Impedance Spectroscopy of Porin and Gramicidin Pores Reconstituted into Supported Lipid Bilayers on Indium-Tin-Oxide Electrodes; Langmuir; 14(11); pp. 3118-3125; (month unavailable 1998).

Haisma; Direct Bonding in Patent Literature; Philips. J. Res.; vol. 49; issues 1-2; pp. 165-170; (month unavailable 1995).

(56) References Cited

OTHER PUBLICATIONS

Hunter; Foundations of Colloid Science vol. II (Oxford Univ. Press, Oxford) pp. 994-1002; (Sep. 14, 1989).
Jackson, J. D.; Classical Electrodynamics 2nd Ed. John Wiley & Sons, Inc. New York. (Oct. 3, 1975).
Jacobasch et al.; Adsorption of ions onto polymer surfaces and its influence on zeta potential and adhesion phenomena, Colloid Polym Sci.; vol. 276(5): pp. 434-442 (May 1998).
Jarvis et al.; Fuel cell / electrochemical capacitor hybrid for intermittent high power applications; J. Power Sources; vol. 79(1); pp. 60-63; (May 1999).
Jenkins, Donald et al., Viscosity B-Coefficients of Ions in Solution, Chem. Rev.; vol. 95; No. 8; pp. 2695-2724; (Dec. 1995).
Jessensky et al.; Self-organized formation of hexagonal pore structures in anodic alumina; J. Electrochem. Soc.; vol. 145; (11); pp. 3735-3740 (Nov. 1998).
Jimbo et al.; Surface Characterization of Poly(acrylonitrite) Membranes: Graft-Polymerized with Ionic Monomers as Revealed by Zeta Potential Measurements; Macromolecules; vol. 31; No. 4; pp. 1277-1284; (month unavailable 1998).
Johnson et al.; Dependence of the conductivity of a porous medium on electrolyte conductivity; Physical Review Letters; 37(7); pp. 3502-3510 (Mar. 1, 1988).
Johnson et al.; New pore-size parameter characterizing transport in porous media; Physical Review Letter; 57(20); pp. 2564-2567 (Nov. 17, 1986).
Johnson et al.; Theory of dynamic permeability and tortuosity in fluid-saturated porous media; J. Fluid Mech; 176; pp. 379-402 (Mar. 1987).
Jones et al.; The viscosity of aqueous solutions of strong electrolytes with special reference to barium chloride; J. Am. Chem. Soc.; vol. 51; pp. 2950-2964; (Oct. 5, 1929).
Kiriy, Anton et al., Cascade of Coil-Globule Conformational Transitions of Single Flexible Polyelectrolyte Molecules in Poor Solvent, J. Am. Chem. Soc.; vol. 124(45); pp. 13454-13462; (Nov. 13, 2002).
Klein, F.; Affinity Membranes: a 10 Year Review; J. Membrance Sci.; vol. 179; issues 1-2; pp. 1-27; (Nov. 15, 2000).
Kobatake et al.; Flows through charged membranes. I. flip-flop current vs voltage relation; J. Chem. Phys.; 40(8); pp. 2212-2218 (Apr. 1964).
Kobatake et al.; Flows through charged membranes. II. Oscillation phenomena; J. Chem. Phys.; 40(8); pp. 2219-2222 ( Apr. 1964).
Kotz et al.; Principles and applications of electrochemical capacitors; Electrochimica Acta; vol. 45; issues 15-16; pp. 2483-2498; (May 3, 2000).
Krasemann et al.; Self-assembled polyelectrolyte multilayer membranes with highly improved pervaporation separation of ethanol/water mixtures; J of Membrane Science; vol. 181; No. 2; pp. 221-228; (Jan. 30, 2001).
Liu et al.; Electroosmotically pumped capillary flow-injection analysis; Analytica Chimica Acta; vol. 283; issue 2; pp. 739-745; (Nov. 26, 1993).
Liu et al.; Flow-injection analysis in the capillary format using electroosmotic pumping; Analytica Chimica Acta; vol. 268; issue 1; pp. 1-6; (Oct. 7, 1992).
Losche et al., Detailed structure of molecularly thin polyelectrolyte multilayer films on solid substrates as revealed by neutron reflectometry; Macromolecules; vol. 31(25); pp. 8893-8906; (Dec. 15, 1998).
Ma et al.; A review of zeolite-like porous materials; Microporous and Mesoporous Materials; vol. 37; issues 1-2; pp. 243-252 (May 2000).
Manz et al.; Electroosmotic pumping and electrophoretic separations for miniaturized chemical analysis systems; J. Micromach. Microeng.; vol. 4; issue 4; pp. 257-265; (month unavailable 1994).
Martin et al.; Laminated Plastic Microfluidic Components for Biological and Chemical Systems; J. Vac. Sci. Technol. A; Second Series; vol. 17; No. 4; part II; pp. 2264-2269; (Jul.-Aug. 1999).
Mika et al., A new class of polyelectrolyte-filled microfiltration membranes with environmentally controlled porosity, Journal of Membrane Science; vol. 108; issues 1-2; pp. 37-56; (Dec. 15, 1995).
Morrison et al.; Electrokinetic energy conversion in ultrafine capillaries; J. Chem. Phys.; vol. 43; No. 6; pp. 2111-2115 (Sep. 15, 1965).
Mroz et al.; Disposable Reference Electrode; Analyst; vol. 123;No. 6; pp. 1373-1376; (Jun. 1998).
Nakanishi et al.; Phase separation in silica sol-gel system containing polyacrylic acid; Journal of Crystalline Solids; 139; pp. 1-13; (month unavailable 1992).
Paul et al., Electrokinetic pump application in micro-total analysis systems mechanical actuation to HPLC; Micro Total Analysis Systems 2000; Proceedings of the μTAS 2000 Symposium, held in Enschede, The Netherlands; pp. 583-590; (May 14-18, 2000).
Paul et al.; Electrokinetic generation of high pressures using porous microstructures; Micro Total Analysis Systems '98; Proceedings of the μTAS '98 Workshop, held in Banff, Canada; pp. 49-52 (Oct. 13-16, 1998).
Peters et al.; Molded rigid polymer monoliths as separation media for capillary electrochromatography; Anal. Chem.; vol. 69; No. 17; pp. 3646-3649; (Sep. 1, 1997).
Philipse, A.P., Solid opaline packings of colloidal silica spheres; Journal of Materials Science Letters; 8; pp. 1371-1373 (month unavailable 1989).
Pretorius et al.; Electro-osmosis: a new concept for high-speed liquid chromatography; Journal of Chromatography; vol. 99; pp. 23-30; (month unavailable 1974).
Rastogi, R.P.; Irreversible thermodynamics of electro-osmotic effects; J. Scient. Ind. Res.; (28); pp. 284-292 (Aug. 1969).
Rice et al.; Electrokinetic flow in a narrow cylindrical capillary; J. Phys. Chem.; 69(11); pp. 4017-4024 (Nov. 1965).
Roberts et al.; UV Laser Machined Polymer Substrates for the Development of Microdiagnostic Systems; Anal. Chem.; vol. 69; No. 11; pp. 2035-2042; (Jun. 1, 1997).
Rosen, M.J.; Ch.2—Adsorption of surface-active agents at interfaces: the electrical double layer; Surfactants and Interfacial Phenomena, Second Ed., John Wiley & Sons, pp. 32-107; (Feb. 1989).
Schlenoff et al., Mechanism of polyelectrolyte multilayer growth: charge overcompensation and distribution; Macromolecules; vol. 34; No. 3; pp. 592-598; (Jan. 30, 2001).
Schmid et al.; Electrochemistry of capillary systems with narrow pores V. streaming potential: donnan hindrance of electrolyte transport; J. Membrane Sci.; vol. 150; issue 2; pp. 197-209 (Nov. 25, 1998).
Schmid, G.; Electrochemistry of capillary systems with narrow pores. II. Electroosmosis; J. Membrane Sci.; vol. 150; issue 2; pp. 159-170 (Nov. 25, 1998).
Schweiss et al., Dissociation of Surface Functional Groups and Preferential Adsorption of Ions on Self-Assembled Monolayers Assessed by Streaming Potential and Streaming Current Measurements, Langmuir; vol. 17, No. 14; pp. 4304-4311; (month unavailable 2001).
Stokes, V. K.; Joining Methods for Plastics and Plastic Composites: An Overview; Poly. Eng. and Sci.; vol. 29; No. 19; pp. 1310-1324; (mid-Oct. 1989).
Takamura, Y., et al., "Low-Voltage Electroosmosis Pump and Its Application to On-Chip Linear Stepping Pneumatic Pressure Source," Abstract, Micro Total Analysis Systems, pp. 230-232; (month unavailable 2001).
Takata et al.; Modification of Transport Properties of Ion Exchange Membranes; J. Membrance. Sci.; vol. 179; No. 1; pp. 101-107; (Nov. 15, 2000).
Taylor, G.; Dispersion of soluble matter in solvent flowing slowly through a tube; Prox. Roy. Soc. (London); 21; pp. 186-203; (Mar. 31, 1953).
Tuckerman et al.; High-performance heat sinking for VLSI; IEEE Electron Dev. Letts., vol. EDL-2, pp. 126-129; (May 1981).
Tusek et al.; Surface characterisation of NH3 plasma treated polyamide 6 foils; Colloids and Surfaces A; vol. 195; Nos. 1-3; pp. 81-95; (Dec. 30, 2001).
Uhlig et al.; The electro-osmotic actuation of implantable insulin micropumps; Journal of Biomedical Materials Research; vol. 17(6); pp. 931-943; (Nov. 1983).
Vinson, J.; Adhesive Bonding of Polymer Composites; Polymer Engineering and Science; vol. 29; No. 19; pp. 1325-1331; (Oct. 1989).

(56) References Cited

OTHER PUBLICATIONS

Watson et al.; Recent Developments in Hot Plate Welding of Thermoplastics; Poly. Eng. and Sci.; vol. 29; No. 19; pp. 1382-1386; (mid-Oct. 1989).
Weidenhammer, Petra et al., Investigation of Adhesion Properties of Polymer Materials by Atomic Force Microscopy and Zeta Potential Measurements, Journal of Colloid and Interface Science, vol. 180, issue 1; pp. 232-236; (Jun. 1, 1996).
Weston et al.; Instrumentation for high-performance liquid chromatography; HPLC and CE, Principles and Practice, Academic Press; (Chp. 3) pp. 82-85; (month unavailable 1997).
Wijnhoven et al.; Preparation of photonic crystals made of air spheres in titania; Science; 281; pp. 802-804 (Aug. 7, 1998).
Yazawa, T., Present status and future potential of preparation of porous glass and its application; Key Engineering Materials; 115; pp. 125-146 (month unavailalble 1996).
Ye et al.; Capillary electrochromatography with a silica column with dynamically modified cationic surfactant; Journal of Chromatography A; vol. 855(1); pp. 137-145; (Sep. 3, 1999).
Yoo et al., Controlling Bilayer Composition and Surface Wettability of Sequentially Adsorbed Multilayers of Weak Polyelectrolytes, Macromolecules; vol. 31; No. 13; pp. 4309-4318; (month unavailable 1998).
Zeng, S. et al., "Fabrication and characterization of electroosmotic micropumps," Sensors and Actuators, B: Chemical; vol. 79; issues 2-3; pp. 107-114; (Oct. 15, 2001).
Anex, Deon S.; U.S. Appl. No. 13/465,939 entitled "Gel Coupling for Electrokinetic Delivery Systems," filed May 7, 2012.
Nip et al.; U.S. App. No. 13/465,927 entitled "Ganging Electrokinetic Pumps," filed May 7, 2012.
Nip et al.; U.S. Appl. No. 13/465,902 entitled "System and Method of Differential Pressure Control of a Reciprocating Electrokinetic Pump," filed May 7, 2012.
Anex et al.; U.S. Appl. No. 13/764,568 entitled "Electrokinetic Pump Designs and Drug Delivery Systems," filed Feb. 11, 2013.

* cited by examiner

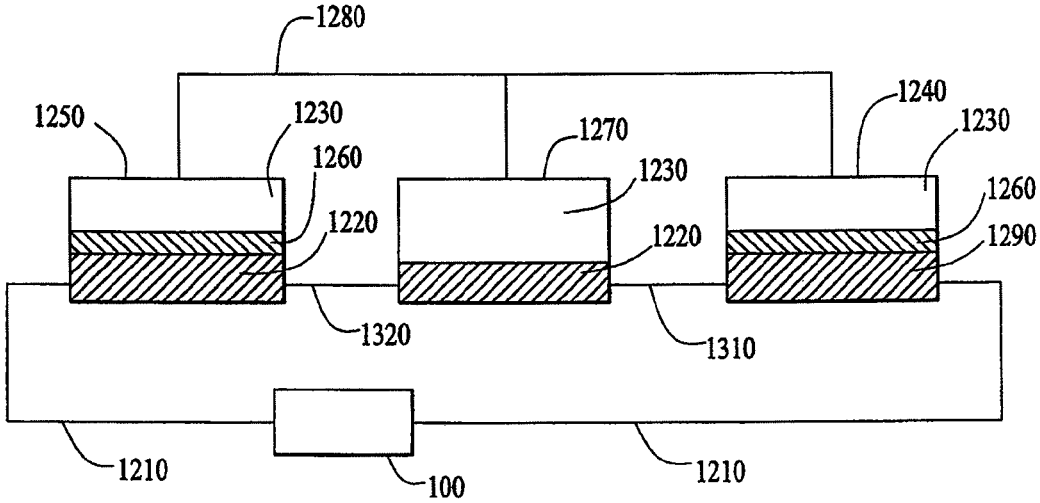
FIG. 9
FIG. 10
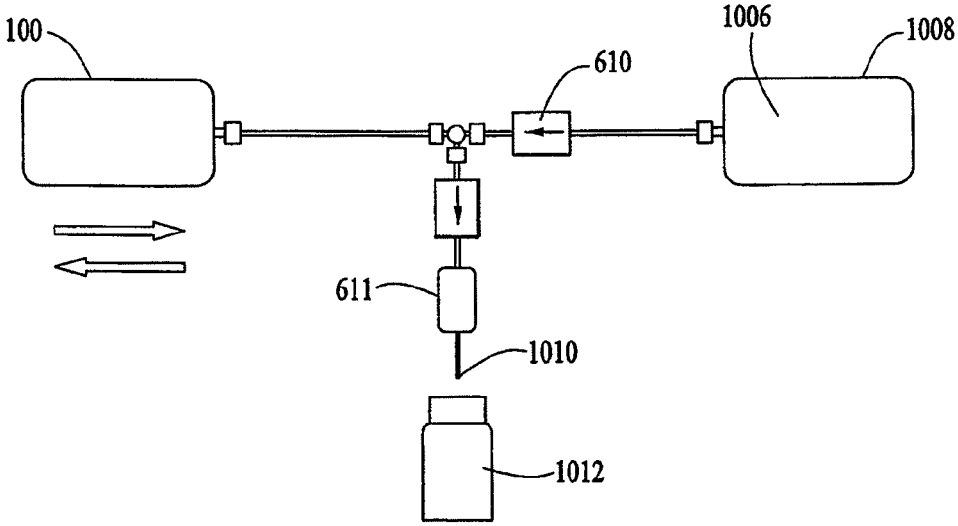

ELECTROKINETIC PUMP HAVING CAPACITIVE ELECTRODES

CROSS REFERENCE TO RELATED APPLICATIONS

This application is a continuation of U.S. patent application Ser. No. 13/013,484, filed Jan. 25, 2011, entitled "ELECTROKINETIC PUMP HAVING CAPACTIIVE ELECTRODES," now Publication No. US-11-0114492-A1, published May 19, 2011, which is a continuation of U.S. patent application Ser. No. 11/684,500, filed Mar. 9, 2007 entitled "ELECTROKINETIC PUMP HAVING CAPACITIVE ELECTRODES," now U.S. Pat. No. 7,875,159, issued Jan. 25, 2011, which is a divisional of U.S. patent application Ser. No. 10/273,723, filed Oct. 18, 2002 entitled "ELECTROKINETIC PUMP HAVING CAPACITIVE ELECTRODES," now U.S. Pat. No. 7,235,164, issued Jun. 26, 2007, each of which are incorporated by reference in their entirety.

INCORPORATION BY REFERENCE

All publications and patent applications mentioned in this specification are herein incorporated by reference to the same extent as if each individual publication or patent application was specifically and individually indicated to be incorporated by reference.

BACKGROUND

Electrokinetic flow devices in the prior art employ simple wire or wire mesh electrodes immersed in a fluid. In these prior art devices, gas produced by current flowing through the electrodes must be vented and pH evolution must be tolerated. Therefore, the conductivity of the fluid and hence, the flow rate of the fluid, are limited in order to limit the amount of gas produced and the rate of pH evolution. Some prior art ignores the pH evolution. Moreover, since gas is produced and must be vented, these prior art flow devices cannot operate for extended periods of time in a closed system.

Others, such as U.S. Pat. Nos. 3,923,426; 3,544,237; 2,615,940; 2,644,900; 2,644,902; 2,661,430; 3,143,691; and 3,427,978, teach mitigation of irreversible pH evolution by using a low conductivity fluid so as to draw as little current as possible. Hence, these prior art devices are only successful when operating for a limited amount of time or when operating at a low current and, hence, low flow rate, e.g., 0.1 mL/min.

U.S. Pat. No. 3,923,426 teaches periodic switching of the polarity of the electrodes to prolong the life of an electrokinetic flow device.

Accordingly, there is a need in the art for an electrokinetic pump that is capable of extended operation in a closed system without producing significant gaseous by-products and without significant evolution of the fluid in the pump ("pump fluid").

Further, and more specifically, there is a need in the art for a high flow rate (e.g. greater than 1 ml/min) electrokinetic pump, and a low flow rate (e.g. in the range of about 25 mL/min to 100 microliters/min) electrokinetic pump that is capable of extended operation (i.e. multiple days to greater than multiple weeks) in a closed system without producing gaseous by-products and without significant evolution of the fluid in the pump.

SUMMARY OF THE DISCLOSURE

The present invention provides an electrokinetic device capable of achieving high as well as low flow rates in a closed system without significant evolution of the pump fluid.

The electrokinetic device comprises a pair of electrodes capable of having a voltage drop therebetween and a porous dielectric material between the electrodes. The electrodes are made of a capacitive material having a capacitance of at least $10^{-4}$ Farads/cm$^2$ or, more preferably, $10^{-2}$ Farads/cm$^2$.

The electrodes preferably are comprised of carbon paper impregnated with carbon aerogel or comprised of a carbon aerogel foam. The porous dielectric material can be organic (e.g. a polymer membrane) or inorganic (e.g. a sintered ceramic). The entire electrokinetic device can be laminated.

The capacitance of the electrodes is preferably charged prior to the occurrence of Faradaic processes in the pump fluid. A method of using the electrokinetic devices comprises the steps of: applying a positive current to the electrodes, thereby charging the capacitance of the electrodes; and applying a negative current to the electrodes, thereby charging the capacitance to the opposite polarity.

The capacitance of the electrodes can be that associated with the electrochemical double-layer at the electrode-liquid interface.

Alternatively, the electrodes can be made of a pseudocapacitive material having a capacitance of at least $10^{-4}$ Farads/cm$^2$. For example, the pseudocapacitive material can be a substantially solid redox material, such as ruthenium oxide.

There can be a spacer between the porous dielectric material and the electrodes. The spacer can minimize undesirable effects associated with electrode roughness or irregularities. An electrode-support material can sandwich the electrodes and the porous dielectric material, so that when there is a current flux on the electrodes it is uniform. The flow resistance of the spacer, the support material, and electrodes can be less than that of the porous dielectric material.

The embodiments of pumps described thus far may be included in various pump systems described herein.

BRIEF DESCRIPTION OF THE DRAWINGS

These and other features, aspects and advantages of the present invention will become better understood with regard to the following description, appended claims, and accompanying drawings where:

FIG. 9 schematically illustrates a two-phase heat transfer system that employs a direct electrokinetic pump according to the present invention;

FIG. 10 schematically illustrates a system for contactless dispensing utilizing an electrokinetic pump according to the invention.

DETAILED DESCRIPTION

Definitions

Double-layer capacitance—capacitance associated with charging of the electrical double layer at an electrode—liquid interface.

Pseudocapacitance—capacitance associated with an electrochemical oxidation or reduction in which the electrochemical potential depends on the extent of conversion of the electrochemically active species. It is often associated with surface processes. Examples of systems exhibiting pseudocapacitance include hydrous oxides (e.g. ruthenium oxide), intercalation of Li ions into a host material, conducting polymers and hydrogen underpotential deposition on metals.

Faradaic process—oxidation or reduction of a bulk material having an electrochemical potential that is (ideally) constant with extent of conversion.

Capacitance per area—the capacitance of an electrode material per unit of surface geometric area (i.e. the surface area calculated from the nominal dimensions of the material), having units Farads/cm$^2$. The geometric area is distinguished from the microscopic surface area. For example, a 1 cm by 1 cm square of aerogel-impregnated carbon paper has a geometric area of 1 cm$^2$, but its microscopic area is much higher. For paper 0.25 mm thick the microscopic area is in excess of 1000 cm$^2$.

Capacitive electrodes—electrodes made from a material having a double-layer capacitance per area, pseudocapacitance per area, or a combination of the two of at least $10^{-4}$ Farads/cm$^2$ and more preferably, at least $10^{-2}$ Farads/cm$^2$.

Pseudocapacitive electrodes—electrodes made from a material having a capacitance of at least $10^{-4}$ Farads/cm$^2$ resulting primarily from pseudocapacitance.

Structure

The present invention is directed to an electrokinetic device capable of achieving high as well as low flow rates in a closed system without significant evolution of the pump fluid. This invention is directed to electrokinetic pumps having a porous dielectric material between a pair of electrodes that provide for conversion of electronic conduction (external to the pump) to ionic conduction (internal to the pump) at the electrode-fluid interface without significant solvent electrolysis, e.g., hydrolysis in aqueous media, and the resultant generation of gas. The electrodes also work well in non-aqueous systems. For example, pumps embodying the invention can be used to pump a propylene carbonate solvent with an appropriate electrolyte, such as tetra(alkyl)ammonium tetrafluoroborate. Through the controlled release and uptake of ions in the pump fluid, the electrodes are designed to evolve the pump fluid in a controlled fashion.

Figure 1A:
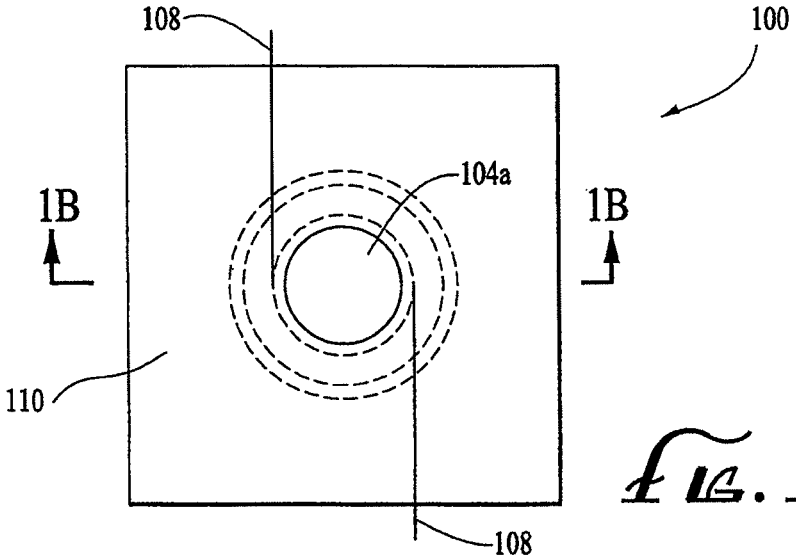
FIG. 1A is a front elevation view of a first embodiment of a high flow rate pump in accordance with the present invention.
Figure 1B:
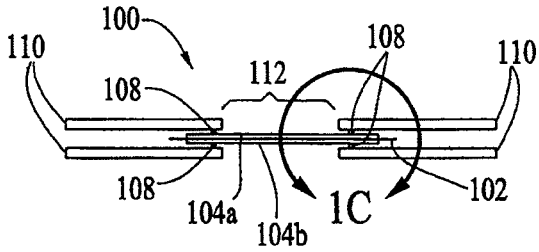
FIG. 1B is a top cross-sectional view of the pump of FIG. 1A.
Figure 1C:
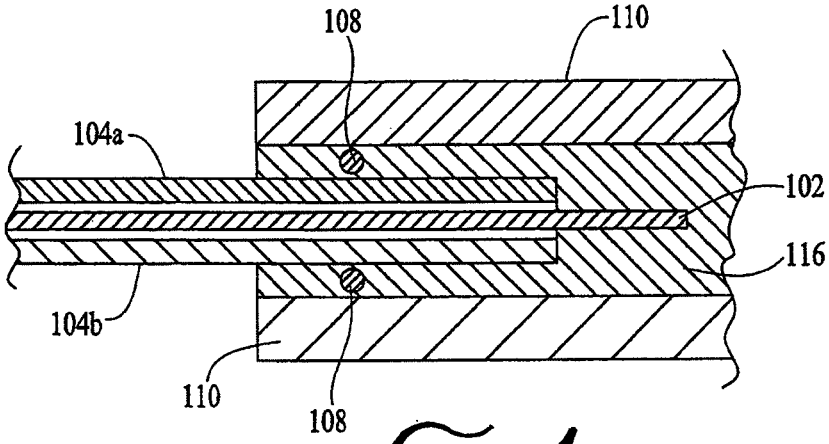
FIG. 1C illustrates enlarged detail view of the pump of FIG. 1A in region 1C identified in FIG. 1B.

With reference to FIGS. 1A, 1B and 1C, a pump 100 according to the present invention has a porous dielectric material 102 sandwiched between two capacitive electrodes 104*a* and 104*b* having a voltage drop therebetween. The electrodes 104*a* and 104*b* preferably directly contact the porous dielectric material 102 so that the voltage drop across the porous dielectric material preferably is at least 10% of the voltage drop between the electrodes, more preferably at least 50% of the voltage drop between the electrodes, and most preferably at least 85% of the voltage drop between the electrodes. This configuration maximizes the potential across the pump material 102 so that a lower total applied voltage is required for a given flow rate. It is advantageous for the pump 100 to have a low drive voltage so that it is suitable for integration into compact systems or for close coupling to sensitive electronic devices. Further, sandwich structures with the electrodes 104*a* and 104*b* in intimate contact with the porous dielectric material 102 prevent the flexure of the porous dielectric material when the pump 100 is configured to pump through the face of the porous dielectric material. Pump flexure reduces the amount of pump fluid pumped in a cycle.

Preferably electrical leads 108 are placed in contact with outside surfaces of the electrodes 104*a* and 104*b*. The porous dielectric material 102, electrodes 104*a* and 104*b* and the leads 108 can be sandwiched between supports 110, each having a hole 112 so that the pump fluid can flow through the porous dielectric material 102 and the electrodes 104*a* and 104*b*. The supports 110 help to maintain the planarity of the pump 100. Maintaining the planarity of the pump 100 helps to maintain a uniform current flux on the electrodes 104*a* and 104*b*.

Figure 2:
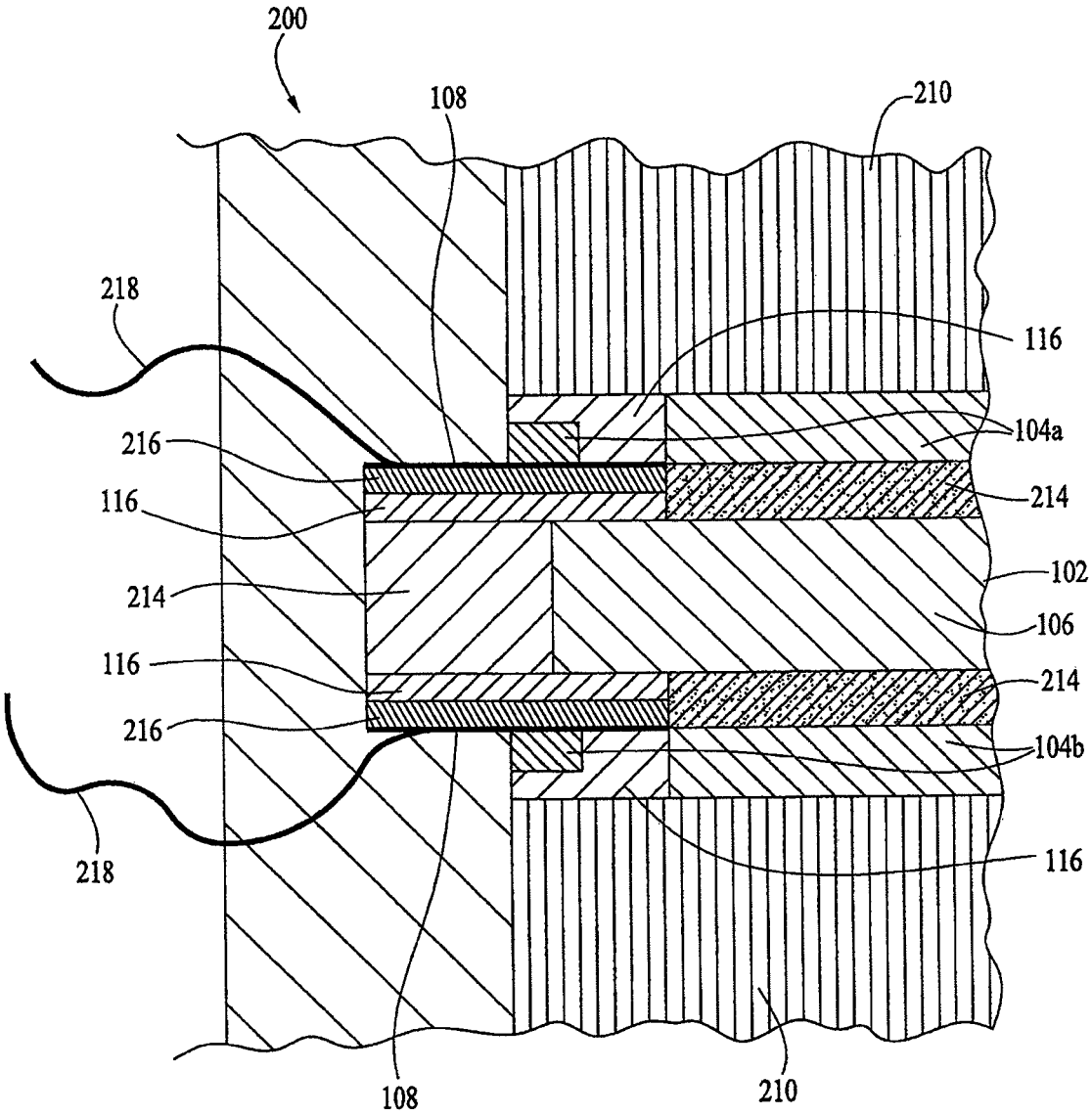
FIG. 2 is a cross-sectional view of a portion of a second embodiment of an electrokinetic pump in accordance with the invention.

The pump 100 is preferably laminated using a bonding material 116 so that the pump and its lamination forms an integrated assembly that may be in the form of a chip-like assembly as described in U.S. patent application entitled Laminated Flow Device invented by Phillip H. Paul, David W. Neyer, and Jason E. Rehm, filed on Jul. 17, 2002, Ser. No. 10/198,223, now U.S. Pat. No. 7,364,647, issued on Apr. 29, 2008, and incorporated herein by reference. Pump 200 illustrated in FIG. 2 is laminated. Alternatively, the pump 100 can be placed on an etched chip, for example, or incorporated into a flow system by any other means known in the art.

A spacer 214, shown in FIG. 2, can be used to provide a gap between the electrodes 104*a* and 104*b* and the porous dielectric material 102 to aid in smoothing the current flux density at the electrodes and to prevent puncture of the porous dielectric material when the electrodes have sharp edges or points. Use of the spacer 214 is preferable when the electrodes 104*a* and 104*b* have surface irregularities. The electrodes 104*a* and 104*b* in FIG. 2 have lead-out rings 216, which have flying leads 218.

In the preferred embodiment, over 85% of the voltage drop between the electrodes 104*a* and 104*b* appears across the porous dielectric material 102. To this end, it is preferable that the electrical resistances of the spacers 214 are much less than that of the porous dielectric materials 102.

In FIG. 1, supports 110 clamp the periphery of the assembled porous dielectric material 102, electrodes 104*a* and 104*b* and the leads 108. In FIG. 2, further support of the assembled porous dielectric material 102, electrodes 104*a* and 104*b*, leads 108, and spacers 214 can be provided by electrode-supports 210. These electrode-supports 210 can be, for example, rigid porous frits or sections of honeycomb-like material.

In the preferred embodiment, there is minimal pressure loss due to flow through the spacers 214, the electrodes 104*a* and 104*b*, and the electrode-supports 210. To this end, it is preferable that: the flow resistances of the electrode-supports 210 and the electrodes 104*a* and 104*b* are much less than that of the spacers 214, and the flow resistances of the spacers are much less than that of the porous dielectric material 102. This can be accomplished by a careful selection of the pore size of each element.

For example, in FIG. 2 the electrical resistance is proportional to the product of formation factor and thickness divided by the area of each element (here 'thickness' refers to the dimension of a component along the direction of flow, and 'area' refers to the area of the face of an element through which the flow passes). The flow resistance is proportional to the product of formation factor and thickness divided by the product of the area and the square of the pore size for each element.

As a specific example, if the porous dielectric material to has 0.2 micron pores, a formation factor of 3 and a thickness of 1 mm; the spacers have 3 micron pores, a formation factor of 2 and a thickness of 0.1 mm; the electrodes have 20 micron pores, a formation factor of 3 and a thickness of 2 mm; and the supports have 1 mm pores, a formation factor of 1.2 and a thickness of 3 mm, then the voltage drop across the porous dielectric material is then 88% of the total applied voltage and the flow conductances (i.e. the inverse of the flow resistance) of the porous dielectric, the spacer, the electrode and the support are then about 0.02, 63, 94 and 3900 ml per minute per psi per square cm, respectively.

The diameter of the faces of the pumps 100 and 200, which pump fluid can flow through, are each larger than the thicknesses of the respective pumps so that both pumps resemble a coin, with the flow through the face, as opposed to most low-flow-rate and/or high-pressure designs that are more rod-like with the flow along a longitudinal axis. Pumps embodying the invention do not have to have cylindrical symmetry, but can have any shape.

The area of the pumps 100 and 200 through which fluid can flow is selected to meet flow rate requirements. For example: a pump running at about 3V can achieve an open-load flow-rate of about 1.2 mL/min per $cm^2$ thus an open-load flowrate of 10 mL/min can be achieved with a pump having an area of about 8.8 $cm^2$. The same flow rate can be achieved by running in parallel multiple pumps having smaller areas.

Figure 3A:
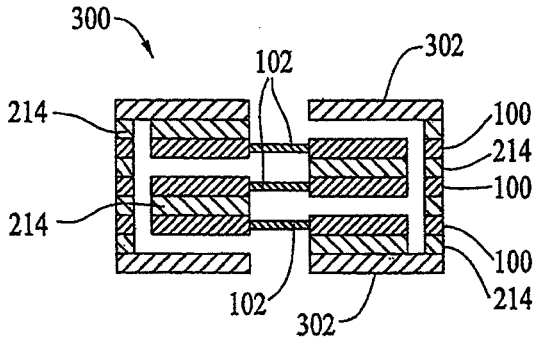
FIG. 3A is a top cross-sectional view of a stack of three electrokinetic pumps of FIG. 1A.
Figure 3B:
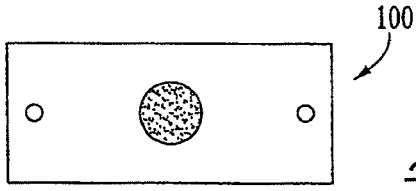
FIG. 3B is a front elevation view of a simple electrokinetic pump in the stack of FIG. 3A.
Figure 3C:
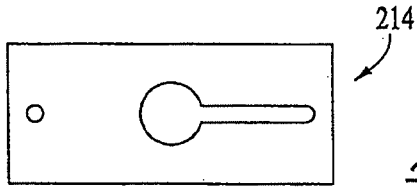
FIG. 3C is a front elevation view of the spacer of FIG. 3A.
Figure 3D:
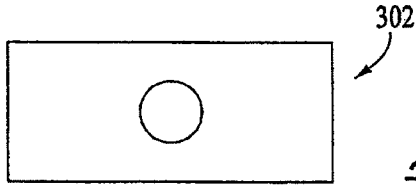
FIG. 3D is a front elevation view of the cap of FIG. 3A.

A compact parallel multiple element pump 300 is shown in FIG. 3A. This multiple element pump 300 comprises a stack of pumps 100 and spacers 214 finished with caps 302. The direction of each pump 100 element, i.e. polarity of the driving voltage, preferably is reversed relative to the adjacent pump so that no voltage drop is applied across the openings created by the spacers 214. Any number of pumps can be combined to form a parallel pump and any size stack can be made out of just three types of elements, caps 302 shown in FIG. 3D, spacers 214 shown in FIG. 3C and pumps 100 shown in FIGS. 3B and 1A-1C. The flow rate of the parallel pump 300 is the sum of the flow rates of each of the pumps 100. Alternatively, the pumps 100 may also be configured in series as described by Rakestraw et al. in U.S. patent application Ser. No. 10/066,528, filed Jan. 31, 2002, now U.S. Pat. No. 6,719,535, issued on Apr. 13, 2004, and entitled Variable Potential Electrokinetic Devices and incorporated herein by reference and act as a pressure amplifier for higher-pressure operation.

Supports

The supports 110 can be formed of any material known in the art that provides sufficient mechanical strength and dielectric strength, such as: polyetherimide (PEI, known by the brand name Ultem), polyethersulfone (PES, known by the brand name Victrex), polyethylene terephthalate (PET, known by the brand name Dacron).

The electrode-supports 210 can be a 3-mm thick honeycomb having 1 mm cells, 50-micron cell wall thickness, and a 92% open area, i.e., 92% of the total area of the electrode-support is open, for example.

The type, cell size, and thickness of the electrode-supports 210 are preferably selected to provide the mechanical strength to maintain the necessary degree of planarity of the pump. It is preferable that any flow-induced flexure of the electrodes (and similar flexure of the pump medium sandwiched between the electrodes) be limited to some small fraction (preferably less than ten percent) of the displacement of the liquid per one-half cycle. For example: a pump running at 15 mL/min, with an oscillatory cycle time of 8 seconds and an area of about 12 $cm^2$, gives a liquid displacement of about 0.8 mm per one-half cycle. In this example, it is preferable that the electrodes be supported in a fashion to limit any electrode flexure to less than 0.08 mm.

Leads

Preferably, the electrical contacts to the electrodes are formed from a metal, preferably platinum, that is electrochemically stable (i.e. not subject to redox reactions) under the electrochemical conditions encountered within the pump liquid environment. The electrical contacts may be in the form of a wire lead that may also serve as a flying lead, or a foil or as a thin layer deposited on an insulating support. Flying leads that are connected to the electrode contacting leads and do not contact the liquid may be of any type common in electrical components and wiring.

Spacers

The spacer 214 can be formed of any large pore dielectric material, such as acrylic copolymer foam membrane or polypropylene. Preferably the thickness of the spacer 214 is as small as possible but greater than one half of the scale of any irregularities in the electrodes 104*a* and 104*b*, e.g. slightly thicker than one half of the wire diameter for a wire mesh electrode. For example, the spacer can have 5-10 micron pores, a formation factor of 1.7 and a 50 micron thickness.

Electrodes

Preferably 25% and, more preferably 50% of the total area of the electrodes 104*a* and 104*b* is open and the electrodes have a flow through design that covers an entire face of the porous dielectric material 102 and a geometric structure that provides good fluid exchange at all the current carrying surfaces to facilitate the replenishment of the ions at the electrodes. In the flow-through design the electrode geometric area preferably matches the geometric area of the pump medium. For example, in a case where the pump medium has a disc of diameter 13 mm, electrodes with 11 mm diameters have been used. Further, the electrodes 104*a* and 104*b* are preferably free of sharp edges and points so as to support without puncturing the porous dielectric material 102 and to provide a uniform current flux. The electrodes can be in the form of carbon paper, carbon foam, perforated plates, porous fits, porous membranes, or wire mesh, for example.

The electrodes 104*a* and 104*b* preferably are made from a material having a double-layer capacitance of at least $10^{-4}$ Farads/cm$^2$, more preferably, at least $10^{-2}$ Farads/cm$^2$, as these electrodes can function with a wide range of pump fluids, i.e., any fluid having a pH value and an ionic content compatible with the porous dielectric material 104, whereas pseudocapacitive electrodes can function with a limited range of pump fluids as they need to be supplied reactants in order to avoid electrolysis of the pump fluid.

Carbon paper impregnated with carbon aerogel is the most preferable electrode material as it has a substantial double-layer capacitance and is free of sharp edges and points. The high capacitance of this material arises from its large microscopic surface area for a given geometric surface area. At high currents, (e.g. 1 mA per square cm) the double layer capacitance is about 10 mF/cm$^2$ and at low currents, (e.g. 1 microamp per square cm) the double-layer capacitance is about 1 F/cm$^2$.

Many other forms of carbon also have very large microscopic surface areas for a given geometric surface area and hence exhibit high double-layer capacitance. For example, carbon mesh, carbon fiber (e.g., pyrolized poly(acrylonitrile) or cellulose fiber), carbon black and carbon nanotubes all have significant double layer capacitance. Capacitive electrodes can be formed of materials other than carbon, even though carbon is preferred as it is an inert element and therefore reactions are slow when the voltage applied to the electrodes accidentally exceeds the electrolysis threshold. Capacitive electrodes can be formed of any conductor having a high microscopic surface area, such as sintered metal.

When pseudocapacitive electrodes are used, the electrode chemistry is arranged to minimize any irreversible electrochemical reactions that might alter the pump fluid and provide for conversion from electronic conduction to ionic conduction at the electrode-fluid interface, so that gaseous products are not produced and irreversible alteration of the pump fluid or electrode materials are not involved. This is accomplished by limiting the rate of unwanted chemical reactions at the electrodes 104*a* and 104*b* by careful optimization of the combination of: the pump fluid, electrode material, the porous dielectric material 102, physical geometry of the pump, the applied potential, and the current flux density at the electrodes 104*a* and 104*b*.

Examples of possible pseudocapacitive electrode-fluid combinations include:

1. Electrode Material or Coating that Represents a Solid Redox Couple.

This can be iridium-, vanadium-, or ruthenium-oxides. These oxides are relatively insoluble in water and many other solvents. Advantage is taken of the multiple oxidation states of the metals but the redox reaction takes place in the solid phase and the charge can be carried as $OH^-$ or $H^+$ ions in the fluid.

2. A Solid Redox Host Material that Dispenses or Inserts a Soluble Ion.

This is commonly termed de-intercalation and intercalation, respectively. For example, $Li^+$ ions may be inserted into solids like titanium, molybdenum di-sulfides, certain polymers or carbon. Redox reactions in the solid results in dispensing or uptake of the $Li^+$ ions to or from the fluid. These ions are stable when stored in the solid and solids with intercalated ions are stable when exposed to the transport fluid, although some are reactive with $H_2O$.

Porous Dielectric Materials

Preferably, inorganic porous dielectric materials are used and more preferably, Anopore® membranes, are employed as the porous dielectric pump material 102 in order to provide both a thin pump (e.g. 60 to 2000 microns), and therefore low drive voltage, and narrow pore size distribution, as well as the capability to have both positive and negative zeta potentials. A narrow pore size distribution is desirable as it makes the pump 100 more efficient. Large pores cause the pump 100 to have reduced pressure performance and pores that are too narrow cause increased charge layer overlap, which decreases the flow rate. Anapore® membranes are composed of a high purity alumina that is highly porous, where the pores are in the form of a substantially close-packed hexagonal array with a pore diameter of approximately 200 nm. Alternatively, packed silica beads or organic materials can be used as the porous dielectric material 102. Whatever material is used, the pores preferably have a diameter in the range of 50-500 nm because it is desirable that the pores be as small as possible to achieve high pump stall pressure but still be large enough to avoid substantial double-layer overlap.

Additives to the fluid that provide polyvalent ions having a charge sign opposite to that of the zeta potential of the porous dielectric material are preferably avoided. For example, when the porous dielectric material 102 is comprised of a positive zeta potential material, phosphates, borates and citrates preferably are avoided. For a negative zeta potential material, barium and calcium preferably are avoided.

Use of Electrokinetic Pumps Embodying the Invention

The desired strategy is to apply a current to the electrodes 104*a* and 104*b* to produce a desired flow rate while charging the double-layer capacitance of the electrodes during the first half of the pump cycle. The polarity of the applied field is then changed before Faradaic processes begin, thereby discharging the double-layer capacitance of the electrodes 104*a* and 104*b* and then recharging the electrodes with the opposite polarity causing the pump fluid to flow in the opposite direction during the second half of the pump cycle. This alternation of polarity is referred to here as "AC" operation.

For example, an applied current (1) of 1 mA and a capacitance (C) of 0.3 F results in a voltage rise (dV/dt) of 3.3 mV/sec. At this rate it takes about 5 minutes to increase 1 V. At low enough currents, the time between required polarity changes may be very long and the pump 100 can effectively operate in "DC" mode for some operations.

It is desirable that the electrodes 104*a* and 104*b* supply the current required, even for high flow rates, e.g., greater than 1 mL/min, without significant electrolysis of the pump fluid or significant evolution of the pH of the pump fluid. Avoidance of significant pH evolution of the pump fluid can be accomplished by not allowing the voltage drop between the electrodes 104*a* and 104*b* and the liquid to exceed the threshold for Faradaic electrochemical reactions, which start at approximately 1.2V for water.

The double-layer capacitance or the pseudocapacitance of the electrodes 104*a* and 104*b* preferably is charged prior to the beginning of bulk Faradaic processes. Typical values of double layer capacitance of a plane metal surface (e.g. a drawn metal wire) are 20 to 30 micro Farads/cm$^2$. This value can be substantially increased using methods well-known in the electrochemical arts (e.g. surface roughening, surface etching, platinization of platinum). The double-layer capacitance of the electrodes 104*a* and 104*b* is preferably at least $10^{-4}$ Farads/cm$^2$ and more preferably at least $10^{-2}$ Farads/cm$^2$.

When current flows through pseudocapacitive electrodes, reactants are consumed at the electrodes. When all of the reactants are consumed, gas is produced and the pump fluid may be irreversibly altered. Therefore, preferably the reactants are replenished or current stops flowing through the electrodes before all of the reactants are consumed. The rate that the reactants are supplied to the electrodes 104*a* and 104*b* preferably is high enough to provide for the charge transfer rate required by the applied current. Otherwise, the potential at the electrodes 104*a* and 104*b* will increase until some other electrode reaction occurs that provides for the charge transfer rate required by the current. This reaction may not be reversible.

Thus, when using pseudocapacitive electrodes, the current that can be drawn, hence the electrokinetic flow rate is limited by the transport rate of limiting ionic reactants to or from the electrodes 104*a* and 104*b*. The design of the pump 100 when pseudocapacitive electrodes are used is thus a careful balance between: increasing ionic concentration to support reversible electrode reactions and decreasing ionic concentration to draw less current to prevent irreversible evolution of the pump fluid.

When pseudocapacitive electrodes are used in the pump 100, their electrochemical potential depends on the extent of conversion of the reactants. The dependence of the electrochemical potential on a reaction gives rise to current (I) and voltage (V) characteristics that are nearly described by the equations that characterize the capacitance processes. That is, although the electrodes technically depend on Faradaic processes, they appear to behave as a capacitor.

Figure 4A:
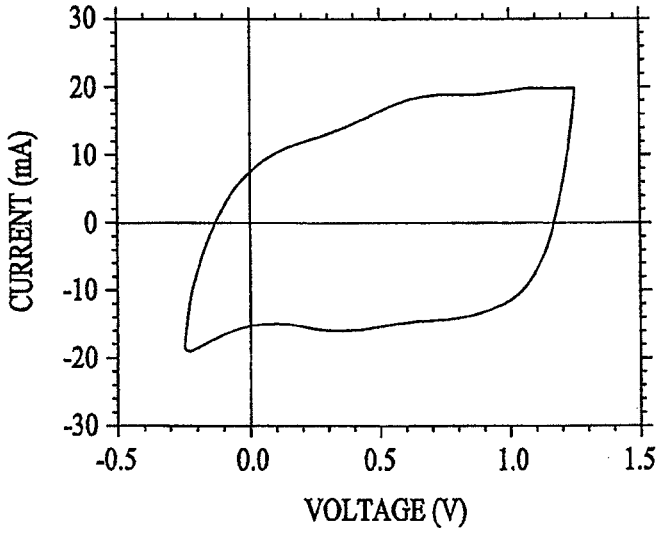
FIG. 4A is a current versus voltage plot for a ruthenium oxide pseudocapacitive electrode that can be used in the pump of FIG. 2.
Figure 4B:
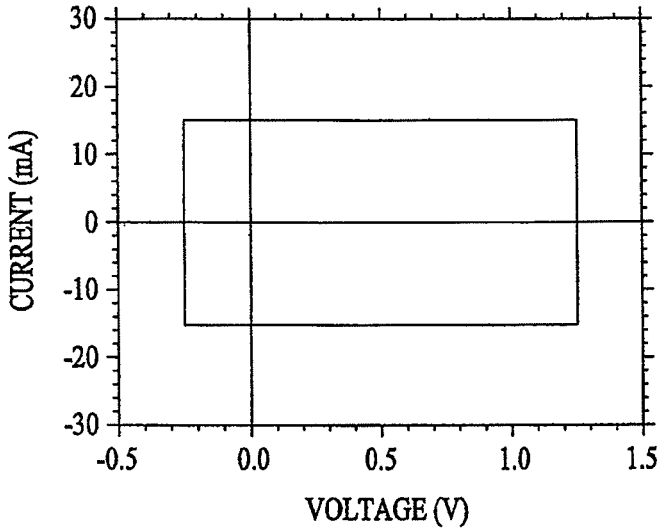
FIG. 4B is a plot of a calculated current versus voltage for a 5 milli Farad capacitor shown for comparative purposes.

An example of the current versus voltage behavior (a cyclic voltammogram) of a ruthenium oxide ($RuO_2$) pseudocapacitive electrode is given in FIG. 4A. The calculated cyclic voltammogram for a 5 mF capacitor is shown for comparison in FIG. 4B. The applied voltage waveform is a triangle wave with an amplitude of 1.5 V peak to peak and a period of 1 second (dV/dt=3 V/sec.) The surface area of the pseudocapacitive electrode was about 0.1 $m^2$. In contrast, the cyclic voltammogram for an electrode based on bulk Faradaic processes would appear as a nearly vertical line in these plots. The current versus voltage behavior that arises from intercalation of an ion, e.g. $Li^+$, into a host matrix or a conducting polymer electrode is similar to that of a ruthenium oxide electrode.

Pseudocapacitive electrodes, which operate using a surface Faradaic electrochemical process, sacrifice some of the chemical universality of capacitive electrodes, which can be charged by almost any ion. Pseudocapacitance is usually centered on the uptake and release of a specific ion, $H^+$ for $RuO_2$ and $Li^+$ for intercalation, for example. Therefore, pseudocapacitive electrodes are compatible with a smaller number of liquids as $RuO_2$ systems are usually run under acidic conditions and many $Li^+$ intercalation compounds are unstable in water.

In general, electrokinetic pumps embodying the invention can be controlled with either voltage or current programming. The simplest scheme is constant current operation. Under these conditions the electrode-liquid potential ramps linearly in time. The charge transferred on each half of the cycle is preferably balanced. This is to avoid the net charging of the electrodes 104*a* and 104*b*. Equal transfer of charge on each half of the cycle can be accomplished by driving the pump 100 with a symmetric constant-current square wave. Alternatively, if the pump 100 is driven with unequal current on each half of the cycle, then the time of each half of the cycle preferably is adjusted so that the current-time product is equal on both halves of the cycle.

More complex driving schemes are possible. For example, the pump 100 can be driven with a constant voltage for a fixed time period on the first half of the cycle. During the first half of the cycle, the current is integrated to measure the total charge transferred. Then, in the second half of the cycle, the reverse current is integrated. The second half of the cycle preferably continues until the integrated current of the second half equals that of the first half of the cycle. This mode of operation may give more precise delivery of the pump fluid. Even more complex tailored waveforms, controlled current or controlled voltage, are possible. Alternatively, an appropriate voltage waveform can be applied, a voltage step followed by a voltage ramp, for example. A number of other voltage- or current-programmed control strategies are possible.

When the potential is reversed at fixed periods, a constant current power supply can be used to provide power to the electrodes. Methods of providing a constant current are well-known in the electrical arts and include, for example, an operational amplifier current regulator or a JFET current limiter. The power supply can be connected to the flying leads 218 via a timed double-pole/double-throw switch that reverses the potential at fixed intervals. Using a more sophisticated circuit, which adds the ability to vary the regulated current, will provide the capacity to vary the flow rate in response to a control signal.

Alternatively, the potential is reversed when the total charge reaches a fixed limit. A time-integrated signal from a current shunt or a signal from a charge integrator preferably is employed to monitor the charge supplied to the pump 100. Once the charge reaches a preset level, the polarity is reversed and integrated signal from the current shunt or charge integrator is reset. Then the process is repeated.

Using either type of power supply configuration, the pump flow rate and pressure can be modulated by varying the electrical input. The electrical input can be varied manually or by a feedback loop. It may be desirable to vary the flow rate and/or the pressure, for example: to vary a heat transfer rate or stabilize a temperature in response to a measured temperature or heat flux; to provide a given flow rate or stabilize a flow rate in response to the signal from a flowmeter; to provide a given pressure or stabilize a pressure in response to a signal from a pressure gauge; to provide a given actuator displacement or stabilize an actuator in response to a signal from displacement transducer, velocity meter, or accelerometer.

Any of the embodiments of the high flow rate electrokinetic pump can be stacked, arranged in several different configurations and used in conjunction with one or more check valves to fit a specific application. The examples given here list some of the different types of pumps, pump configurations, check valve configurations and types of heat transfer cycles.

Types of Pumps:

Single Element Pump

Single element pumps are illustrated in FIGS. 1A-1C and 2. Single element pumps have a single porous dielectric material 102. FIG. 3 illustrates a set of single element pumps arranged in a parallel array.

Dual Element Pump

Figure 5:
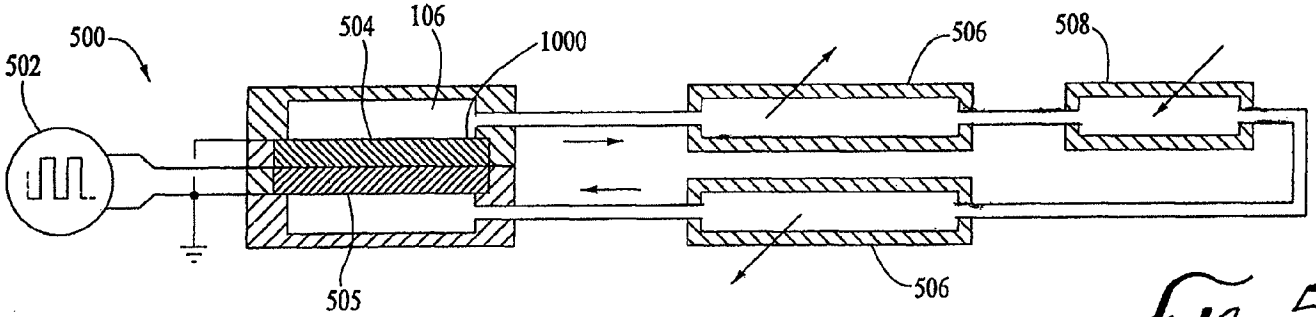
FIG. 5 schematically illustrates a single fluid reciprocating electrokinetic pump driven heat transfer system utilizing an electrokinetic pump according to the present invention.
Figure 6:
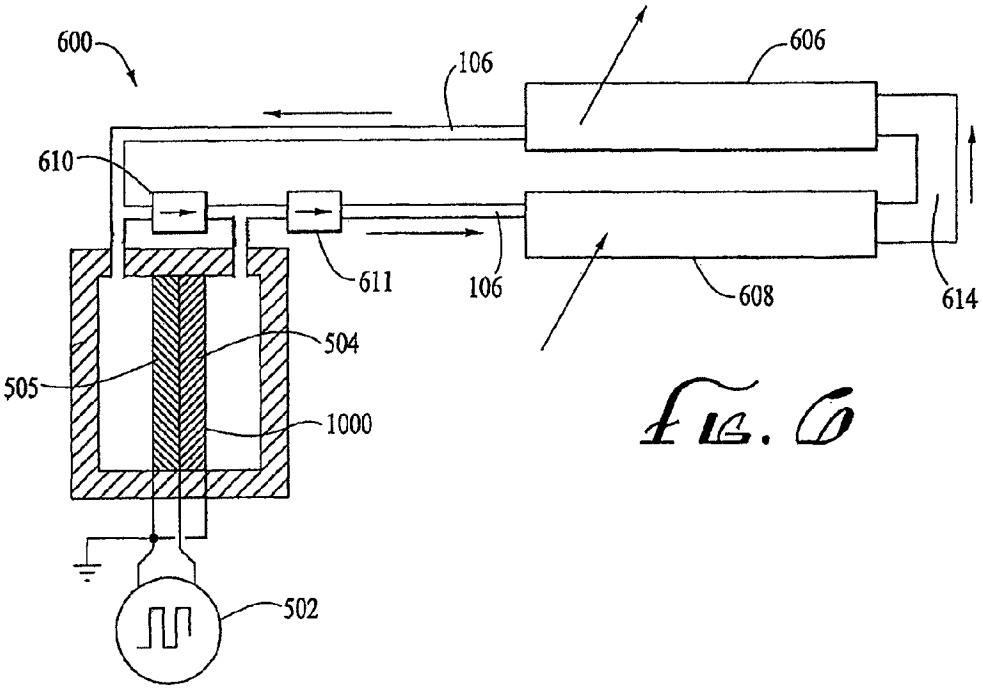
FIG. 6 schematically illustrates a single fluid reciprocating electrokinetic pump driven two phase heat transfer loop using tandem check valves utilizing an electrokinetic pump according to the present invention.
Figure 12:
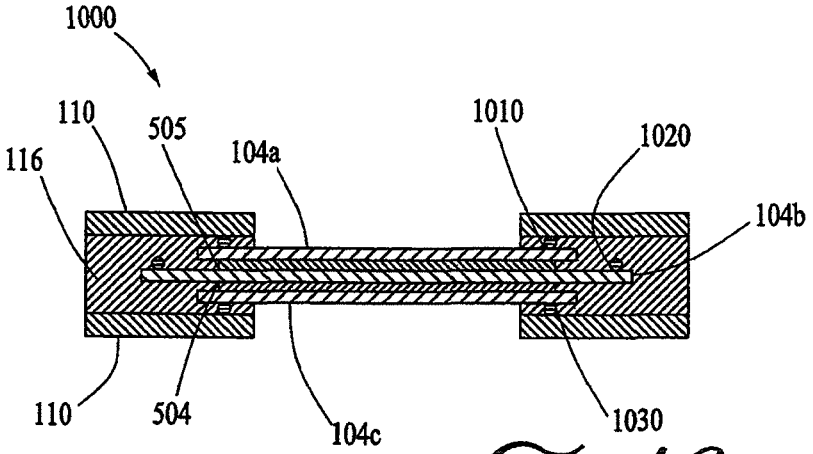
FIG. 12 is a cross-sectional view of a dual element electrokinetic pump in accordance with the present invention.

Dual element pumps 1000, illustrated in FIGS. 5 and 6 and shown in detail in FIG. 12, contain a porous dielectric material 504 having a positive zeta potential and a porous dielectric material 505 having a negative zeta potential. Three electrodes are used in the dual element pumps. Electrode 104*b* is located between the two porous dielectric materials 504 and 505 adjacent to the inside face of each porous dielectric material and electrodes 104*a* and 104*c* are located on or adjacent to the outside face of each of the porous dielectric materials. Electrodes 104*a*, 104*b* and 104*c* are connected to an external power supply (not shown) via leads 1010, 1020 and 1030, respectively. In this embodiment, the electrodes 104*a* and 104*c* preferably are held at ground and the driving voltage from power supply 502 is applied to the center electrode 104*b*.

It is also possible to have multi-element pumps having a plurality of sheets of porous dielectric materials and a plurality of electrodes, one electrode being located between every two adjacent sheets. The value of the zeta potential of each sheet of porous dielectric material has a sign opposite to that of any adjacent sheet of porous dielectric material.

Pump Configurations:

Direct Pump

The porous dielectric material in a direct pump pumps the fluid in the flow path directly. For example, see FIGS. 5 and 6.

Indirect Pump

Figure 7:
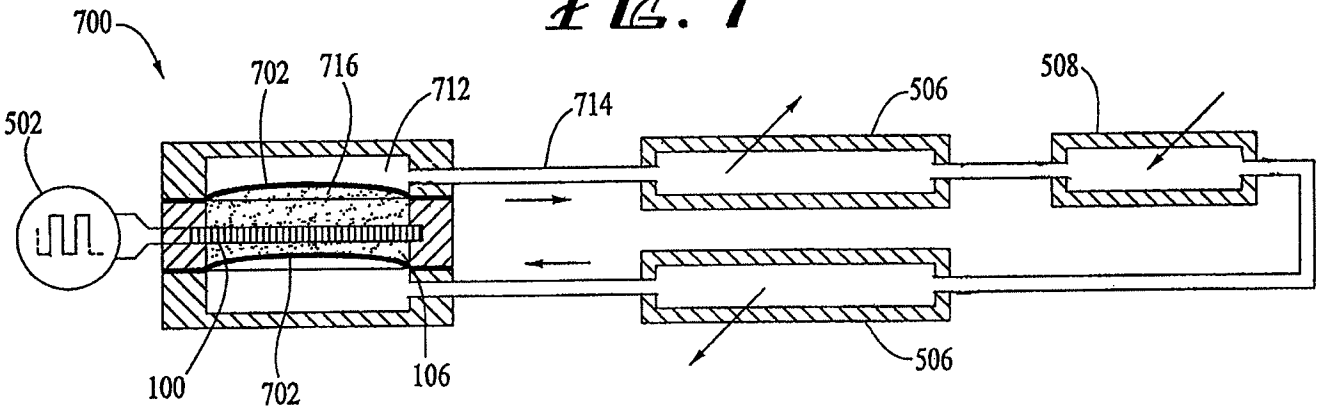
FIG. 7 schematically illustrates a reciprocating electrokinetic pump driven heat transfer system utilizing an electrokinetic pump having two flexible diaphrams according to the present invention.
Figure 8:
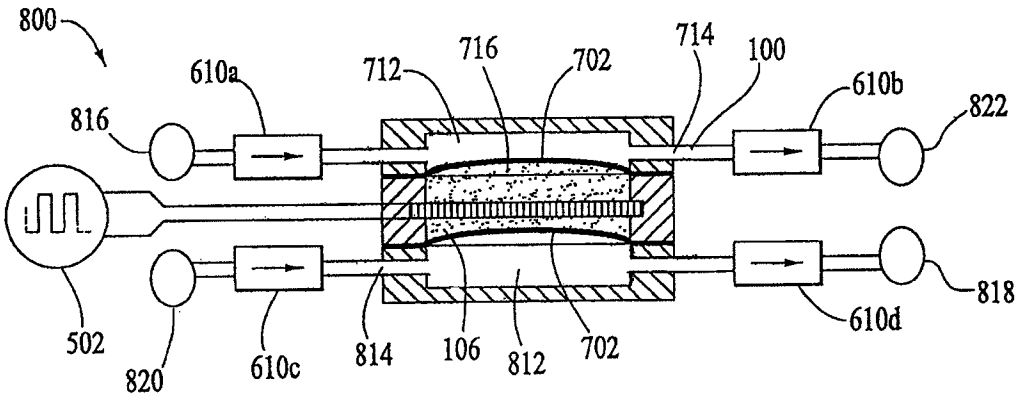
FIG. 8 schematically illustrates an electrokinetic device having a reciprocating electrokinetic pump and four check valves according to the present invention.

Indirect pumps, such as those illustrated in FIGS. 7 and 8, have a flexible impermeable barrier 702, such as a membrane or bellows, physically separating the fluid 106 in the pump 100 and a first flow path 716 from a fluid 712 in a second, external fluid path 714. When the fluid in the pump and the first flow path is pumped, the fluid 106 causes the flexible barrier 702 to flex and pump the fluid 712 in the external fluid path 714.

Check Valve Configurations:

No Check Valves

In some cases no flow limiting devices, e.g., check valves, are needed. In these instances the pump operates in its natural oscillating mode. See, for example, FIGS. 5 and 7.

Two Check Valves

Configurations with two check valves give unidirectional flow, but only pump fluid on one half of the pump cycle, there is no flow on the other half, see for example, FIG. 6.

Four Check Valves

Configurations with four check valves give unidirectional flow and utilize the pump on both halves of the pump cycle, see, for example, FIG. 8. In FIG. 8, there are two separate flow paths 714 and 814 external to the pump 100. In the first half of the pump cycle the first external fluid 712 is pumped through fluid inlet 816 and the check valve 610*a* of the first external flow path 714, while the second external fluid 812 is pumped through check valve 610*d* and out of fluid outlet 818 of the second external flow path 814. In the next half of the pump cycle, the second external fluid 812 is pumped through fluid inlet 820 and check valve 610*c* of the second external flow path 814, while the first external fluid is pumped though the check valve 610*b* and out of fluid outlet 822 of the first external flow path 714. The external fluids 712 and 714 may be the same or different fluids. The external flow paths 714 and 814 can be combined before the check valves 610*a* and 610*c* or after the check valves 610*b* and 610*d* or both.

Types of Heat Transfer Cycles

Single-Phase

Single-phase heat exchangers circulate liquid to carry heat away. See FIGS. 5 and 7. More specifically, FIG. 5, illustrates a single fluid reciprocating electrokinetic pump driven heat transfer system 500. When a positive voltage is applied to the center electrode, the pump 1000 pumps fluid counterclockwise through the system 500 and when a negative voltage is applied to the center electrode, fluid flows clockwise through the system. (Alternatively, if the zeta potentials of the porous dielectric materials were of the opposite sign, the liquid would flow in the opposite direction.) Fluid absorbs heat in the primary heat exchanger 508 and radiates heat in the secondary heat exchangers 506.

Two-Phase

Two-phase heat exchangers rely on a phase change such as evaporation to remove heat. When a direct pump is used in a two-phase heat exchange system, the entire system is preferably configured to recycle the concentrated electrolyte deposited during the evaporation process. This can be done, for example, by using a volatile ionic species, e.g. acetic acid in water. Use of an indirect pump separates the pump liquid, which generally contains added ions, from the heat-transfer liquid.

FIG. 6 illustrates an electrokinetic pump driven two-phase heat transfer loop 600 using a direct pump and tandem check valves 610 and 611. When a negative voltage is applied to the second electrode 104*b* of the pump 1000 the junction of the two check valves is pressurized, the first check valve 610 is closed and the second check valve is opened, and liquid flows towards the evaporator 608. The evaporator 608 absorbs heat and changes the liquid 106 into vapor 614. The vapor 614 travels to the condenser 606 where heat is removed and vapor 614 is transformed back to liquid 106. When a positive voltage is applied to the middle electrode 104*b*, check valve 611 is closed preventing liquid flow in the evaporator/condenser loop and check valve 610 is opened allowing flow around the pump 1000. The second half of the pump cycle, when a positive voltage is applied to the second electrode 104*b*, can be used for electrode regeneration if the charge per half-cycle is balanced.

FIG. 9 shows a two-phase heat transfer system that employs direct pumping. Heat is transferred to liquid 1220 in the evaporator 1270. The addition of heat converts some portion of the liquid 1220 into a vapor 1230 that convects through vapor transfer lines 1280 to condensers 1240 and 1250. Heat is removed from condensers 1250 and 1240 and the resulting drop in temperature results in condensation of vapor 1230. This condensate returns by capillary action through wicks 1260 to the liquid 1220 in the condensers.

Pump 100 operates in an AC mode. During the first half-cycle the pump 100 pushes liquid 1220 from liquid transfer line 1210 to the condenser 1240 and through the liquid transfer line 1310 to evaporator 1270 and also draws liquid (and possibly some vapor) from evaporator 1270 through transfer line 1320 to condenser 1250. On the second half cycle this process is reversed.

The condenser wicks 1260 are made of a porous material that is selected to provide a substantially high resistance to pressure driven liquid flow relative to that of liquid transfer lines 1320 and 1310. Thus the primary result of operation of the pump is displacement of liquid through the transfer lines 1310 and 1320.

The amount of liquid displaced by the pump per half-cycle preferably is greater than the amount of evaporator liquid 1220 vaporized per pump half-cycle. In this manner some liquid is continuously present in the evaporator. Further, the amount of liquid displaced by the pump per half-cycle preferably is sufficient so that fresh liquid from a condenser fully refills the evaporator and so that remaining liquid in the evaporator is fully discharged into a condenser. That is the amount of liquid dispensed per pump half-cycle should exceed the volume of liquid within transfer lines 1310 and 1320 plus the volume of liquid evaporated per half-cycle plus the amount of liquid remaining in the evaporator per half-cycle. In this manner any concentrate, which can result from concentration of any electrolyte as a consequence of distillation of liquid in the evaporator, will be transported by liquid convection and re-diluted in the condensers.

It is preferable to operate this system of evaporator and condensers at the vapor pressure of the operating liquid. Thus the entire system is preferably vacuum leak tight. Prior to operation, the system pressure is reduced to the vapor pressure of the liquid by a vacuum pump or other means known in the arts and then sealed using a seal-off valve or other means known in the arts.

The source of heat input to any of the heat transfer systems disclosed could be, for example, an electronic circuit, such as a computer CPU or a microwave amplifier, that can be directly mounted on or integrated to the evaporators or primary heat exchangers. The removal of heat from the condensers or secondary heat exchangers can be via a passively or actively cooled fin or by any other means known in the arts of heat transfer.

Any combination of pump type, pump configuration, check valve configuration and type of heat transfer cycle can be used with a pump utilizing capacitive, Faradaic or pseudocapacitive electrodes. Other specific applications of electrokinetic pumps embodying the invention aside from heat transfer include, but are not limited to, drug delivery, glucose monitors, fuel cells, actuators, and liquid dispensers.

A high flow rate electrokinetic pump having features of the present invention can be used in liquid dispensing applications that require precise delivery of a given volume of fluid. Often, the application requires contactless dispensing. That is, the volume of fluid is ejected from a dispenser into a receptacle without the nozzle of the dispenser touching fluid in the receptacle vessel. In which case, the configuration of an electrokinetic pump having two check valves, shown in FIG. 10, may be used.

Upon charging the electrodes, the pump 100 withdraws fluid 1006 from a reservoir 1008. The fluid 1006 then passes through a first check valve 610. Upon discharging and recharging the electrodes with the opposite charge, the pump 100 then reverses direction and pushes fluid through the second check valve 611 and out of the nozzle 1010 into a receiving vessel 1012. Precise programmable contactless fluid dispensing across the 10-80 μL range using 0.5 to 2 sec dispense times has been demonstrated.

This embodiment can be a stand-alone component of a dispensing system or can be configured to fit in the bottom of a chemical reagent container. In the later case, the conduits of the electrokinetic pump can be comprised of channels in a plastic plate. The nozzle 1010 can be directly mounted on the plate, and low-profile (e.g. "umbrella" type) check valves can be utilized.

In contactless dispensing applications, the electrokinetic pump must produce sufficient liquid velocity, hence sufficient pressure, at the nozzle tip to eject a well-defined stream from the nozzle. There are other dispensing applications where contactless operation is not needed. Electrokinetic pumps embodying the present invention can be used in these applications as well.

Low-flow-rate pumps in accordance with the present invention can be used in a glucose monitor that delivers 100 mL/min. At this flow rate, electrodes having an area of approximately 1.4 $cm^2$ can run for approximately 7 days before the direction of the current must be changed.

Figure 11A:
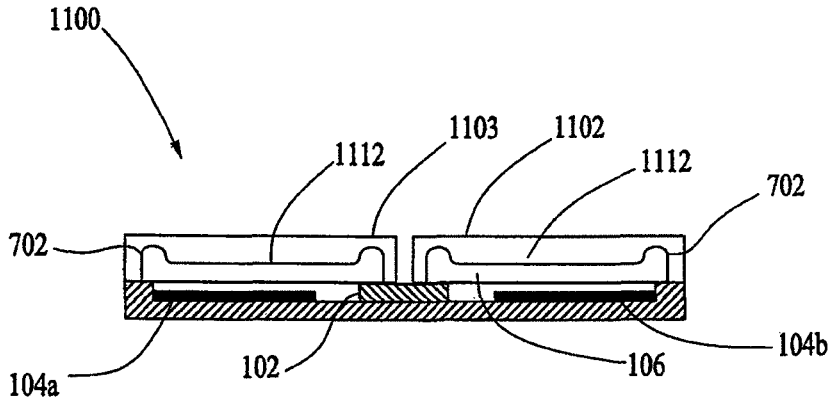
FIG. 11A is a side plan view of a glucose monitor that uses an electrokinetic pump in accordance with the present invention.
Figure 11B:
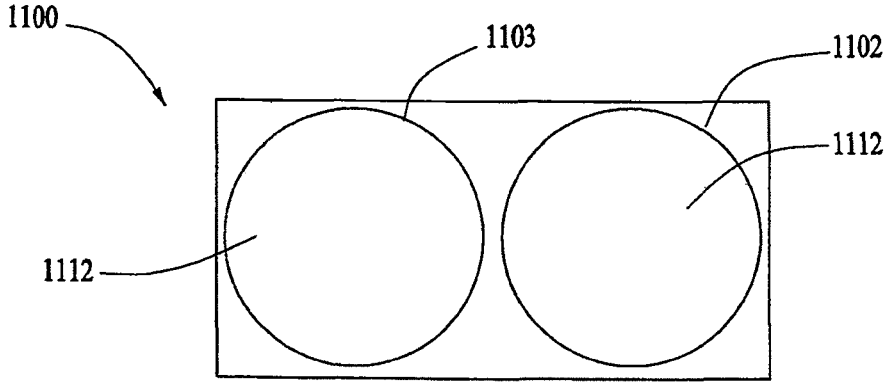
FIG. 11B is a top plan view of the glucose monitor in FIG. 11A.

A design for a low-flow-rate pump that could be used as a glucose monitor pump 1100 is shown in FIGS. 11A and 11B. The pump system pumps fluid indirectly. The pump system has a first reservoir 1102 above a flexible barrier 702. The first reservoir is external to the pump and is filled with the liquid to be delivered (Ringer's solution, for example) 1112. All of the pump fluid 106 remains below the flexible barriers 702. As the pump operates, the pump fluid 106 is pushed through the pump, which extends the flexible barrier 702 and dispenses the liquid 1112. The liquid 1112 circulates through an external loop (not shown), which may contain, for example, a subcutaneous sampling membrane and a glucose sensor, then flows to a second reservoir 1103 external to the pump. This "push-pull" operation of the pump is useful for the glucose sensor (not shown), since it is preferable to keep the sensor at ambient pressure. The design in FIG. 11 may be "folded" such that the reservoirs 1102 and 1103 are stacked to change the footprint of the pump system 1100. The fact that the electrodes 102 do not generate gas and do not alter the pH simplifies the design considerably. It eliminates the need to vent-to-ambient gases produced by electrolysis and eliminates the need to provide a means of controlling the pH of the fluid reservoir (e.g. ion exchange resin in the pump liquid reservoirs).

Advantages of electrokinetic pumps embodying the invention include: gas-free operation, the ability to draw very high current densities (in excess of 20 $mA/cm^2$) and the ability to cycle many times (in excess of 10 million cycles with no apparent change in operating characteristics). Electrokinetic pumps embodying the invention and using capacitive electrodes have the additional advantage of compatibility with a nearly unlimited number of chemical systems.

EXAMPLES

Example 1

The pump 100 illustrated in FIGS. 1A-1C, having a porous dielectric material of a 25-mm diameter Anopore® membrane and 19-mm diameter electrodes in the form of carbon paper impregnated with carbon aerogel, has been used to pump a 1 millimolar sodium acetate buffer having a pH of about 5 at flow rates up to 10 mL/min, about 170 microliters/second, at a driving current of 40 mA.

Example 2

The pump illustrated in FIGS. 1A-1C, having a porous dielectric material of a 13-mm diameter Durapore-Z® membrane, and 11 mm diameter electrodes in the form of carbon paper impregnated with carbon aerogel, and an 8-mm aperture in the PEI, was driven with a +/−0.5 mA square wave with a 10 second period. The pump delivered 0.5 m M lithium chloride at 0.8 microliters/second. It was operated for a total of 35 hours without degradation.

Example 3

The carbon aerogel/Durapore® membrane sandwiched pump was operated in two additional manners. In the second manner of operation, an asymmetric driving current was used to achieve pulsed operation. 0.2 mA was applied for 9.5 seconds and then −3.8 mA was applied for 0.5 seconds. For the first part of the cycle, fluid was drawn slowly backyard through the pump. In the second part of the cycle, fluid was pushed forward, delivering 3 microliters. This is the type of action that can be used for dispensing a liquid.

Example 4

In a third manner of operation, energy stored in the capacitance of the electrode was used to drive the pump. One volt was applied to the electrodes using an external power supply to charge the double-layer capacitance. The power supply was then disconnected. When the external leads were shorted together, fluid flowed in the pump, converting electrical energy stored in the electrodes into fluid flow. If the current had been controlled in an external circuit, the flow rate of the pump could have been programmed, thereby creating a "self-powered" electrokinetic metering pump. The potential applications of such a device include drug delivery.

The process of charging the pump electrodes, either in. the case of the self-powered electrokinetic pump or in the normal charge-discharge cycle of the AC mode, has been described above as being done by means of running the pump in reverse. Another path not through the pump can be provided to charge the electrodes with ions. This involves a high conductivity ionic path and a charging electrode for each pump electrode.

Example 5

The pump illustrated in FIGS. 1A-1C separately pumped 0.5 mM of lithium chloride, 34 mM acetic acid, and about 34 mM carbonic acid. The pump had carbon mesh electrodes and an organic amine-derivatized membrane as the porous dielectric material.

Although the emphasis here is on pumps and systems built from discrete components, many of the components presented here apply equally to integrated and/or microfabricated structures.

Although the present invention has been described in considerable detail with reference to preferred versions thereof, other versions are possible. For example: an electrokinetic pump having features of the present invention can include three or more porous dielectric pump elements. Therefore, the spirit and scope of the appended claims should not be limited to the description of the preferred versions contained herein.

All features disclosed in the specification, including the claims, abstracts, and drawings, and all the steps in any method or process disclosed, may be combined in any combination, except combinations where at least some of such features and/or steps are mutually exclusive. Each feature disclosed in the specification, including the claims, abstract, and drawings, can be replaced by alternative features serving the same, equivalent or similar purpose, unless expressly stated otherwise. Thus, unless expressly stated otherwise, each feature disclosed is one example only of a generic series of equivalent or similar features.

Any element in a claim that does not explicitly state "means" for performing a specified function or "step" for performing a specified function should not be interpreted as a "means" for "step" clause as specified in 35 U.S.C. §112.

What is claimed is:

1. An electrokinetic engine comprising:

a pair of porous capacitive electrodes;

a dielectric material sandwiched between the pair of capacitive electrodes; and a pump fluid;

wherein a width of the electrokinetic engine in a first direction is greater than a thickness of the electrokinetic engine in a second direction, and wherein the porous capacitive electrodes and the dielectric material are in a flow-through configuration such that, during operation of the electrokinetic engine, the pump fluid flows in the second direction through both of the electrodes and the dielectric material.

2. The electrokinetic engine of claim 1, wherein the electrokinetic engine is in approximately the shape of a coin.

3. The electrokinetic engine of claim 1, wherein each of the capacitive electrodes directly contacts the dielectric material.

4. The electrokinetic engine of claim 1, wherein a voltage drop across the dielectric material is at least 50% of a voltage drop between the pair of capacitive electrodes when voltage is applied to the electrodes from a power supply.

5. The electrokinetic engine of claim 1, wherein at least 25% of the total area of each of the capacitive electrodes is open.

6. The electrokinetic engine of claim 1, further comprising a pair of supports sandwiching the pair of capacitive electrodes and dielectric material therebetween, the supports configured to maintain approximate planarity of the electrokinetic engine.

7. The electrokinetic engine of claim 1, wherein at least one of the capacitive electrodes has a width in the first direction approximately equal to a width of the dielectric material in the first direction.

8. The electrokinetic engine of claim 1, wherein each of the capacitive electrodes has a double-layer capacitance of at least $10^{-4}$ Farads/cm$^2$.

9. The electrokinetic engine of claim 1, wherein each of the capacitive electrodes and the dielectric have an approximately circular face perpendicular to the second direction.

10. An electrokinetic system comprising:

an electrokinetic engine including a pair of electrodes, a dielectric material sandwiched between the pair of electrodes, and a pump fluid;

a power supply; and a controller, the controller programmed to:

(a) apply current from the power supply to move the pump fluid through both of the electrodes and the dielectric material; and (b) stop applying the current from the power supply before a solvent electrolysis process starts in the pump fluid.

11. The electrokinetic system of claim 10, further comprising a reservoir including a working fluid, the working fluid in communication with the liquid.

12. The electrokinetic system of claim 11, further comprising a flexible barrier separating the liquid from the working fluid, wherein the movement of the liquid causes the flexible barrier to flex to move the working fluid.

13. The electrokinetic system of claim 10, wherein each of the electrodes has a double-layer capacitance of at least $10^{-4}$ Farads/cm$^2$.

14. The electrokinetic system of claim 10, wherein a width of the electrokinetic engine in a first direction is greater than a thickness of the electrokinetic engine in a second direction, and wherein applying current from the power supply to move the liquid through the electrodes and the dielectric material comprises moving the pump fluid in the second direction.

15. The electrokinetic system of claim 10, wherein each of the electrodes is porous.

16. The electrokinetic engine of claim 10, wherein at least 25% of the total area of each of the electrodes is open.

17. The electrokinetic engine of claim 10, wherein at least one of the electrodes has a diameter approximately equal to a diameter of the dielectric material.

18. The electrokinetic engine of claim 10, wherein the electrokinetic engine is in approximately the shape of a coin.

19. The electrokinetic engine of claim 10, wherein each of the electrodes directly contacts the dielectric material.

* * * * *